United States Patent [19]

Hebner

[11] 4,225,137

[45] Sep. 30, 1980

[54] POLYHEDRONAL GAME APPARATUS

[76] Inventor: Lawrence C. Hebner, 2648 168th NE.,, Bellevue, Wash. 98008

[21] Appl. No.: 949,452

[22] Filed: Oct. 10, 1978

[51] Int. Cl.[3] ..... A63F 3/00

[52] U.S. Cl. ..... 273/241; 273/287; 273/284; 273/DIG. 30

[58] Field of Search ..... 273/241, 282, 283, 284, 273/287, 276, 271; 46/26

[56] References Cited

U.S. PATENT DOCUMENTS

| | | | |
|---|---|---|---|
| 2,282,871 | 5/1942 | Malbon | 273/282 |
| 3,509,642 | 5/1970 | Brumlik | 46/26 |
| 3,608,906 | 9/1971 | Odler | 273/282 X |
| 4,129,303 | 12/1978 | Flagg | 273/241 |

*Primary Examiner*—Richard C. Pinkham
*Assistant Examiner*—Scott L. Brown
*Attorney, Agent, or Firm*—Graybeal & Uhlir

[57] ABSTRACT

Game apparatus comprising a first polyhedronal body suitably in the form of a tetrahedronal pyramid and a second polyhedronal body suitably in the form of a tetrahedronal pyramid are interconnected in spaced parallel relationship by an elongate member which extends through the vertices of and which is aligned with the axis of the two pyramids. Either pyramid can serve as the base for the other during play. The side surfaces of both pyramids are divided into a plurality of areas formed by lines intersecting the mid-points of the adjacent edges of the surfaces of each pyramid. Either pyramid can be used individually or they both can be used together during play. Also, a third pyramid can be placed on top of either of the two pyramids to alter the game apparatus for other types of games. A plurality of markers, suitably magnetic in character and divided into two individually distinct sets, are selectively positionable within the spaces of the first and second pyramids.

20 Claims, 15 Drawing Figures

POLYHEDRONAL GAME APPARATUS

BACKGROUND OF THE INVENTION

1. Field of the Invention

This invention relates to games, and more particularly to marker placement games played on the outer surfaces of polyhedronal bodies.

2. Description of the Prior Art

Three-dimensional game apparatus which incorporate the concept of tic-tac-toe or checkers types of games generally have been constructed of a series of conventional two-dimensional playing surfaces of the kind normally used in checkers or tic-tac-toe. These playing surfaces usually have been arranged in vertical, spaced parallel relationship so that playing pieces can be moved or arranged horizontally about an individual playing surface or vertically between different playing surfaces. One such game apparatus is disclosed by Mahoney U.S. Pat. No. 3,464,701, wherein a series of horizontally disposed playing boards are supported in parallel spaced vertical relationship by a box-shaped frame.

Another three-dimensional game apparatus of the tic-tac-toe type is constructed or rods joined together to form a grid pattern in the shape of a cube. A three-dimensional tic-tac-toe game is played by arranging playing pieces on selected horizontal runs of the grid pattern. A game apparatus of this type is disclosed by Green in U.S. Pat. No. 3,606,333.

Both of the two types of game apparatus, discussed above, increase the difficulty of a conventional tic-tac-toe or checkers game by compounding the game to be played in a third or vertical dimension. In neither of these apparatus has the shape of the conventional tic-tac-toe or checkers playing surface been altered; the playing surfaces are still of square shape and still are divided into smaller, identical square areas.

The only major difference between the conventional checkers or tic-tac-toe playing surface and the known three-dimensional game apparatus, described above, is that such three-dimensional game apparatus are composed of several conventional playing surfaces merely arranged in parallel relationship vertically above one another. Furthermore, generally the same conventional rules are used; a winning combination, for example, in a tic-tac-toe type of game, is obtained by arranging the playing pieces in a straight line in either a vertical, horizontal, or diagonal direction.

A third type of three-dimensional game apparatus which also utilizes a series of horizontally disposed, vertically spaced game surfaces is disclosed by Thompson U.S. Pat. No. 3,656,755, wherein a checkers type game is played. Each playing surface or board is divided into an identical pattern of triangular areas of various sizes and colors. The size of the triangle dictates the number of game pieces which can occupy a particular triangle, while the color of the triangle limits the manner in which the game pieces can be moved or maneuvered. The game pieces can only be moved between triangles of the same color on the same or adjacent planes and through the common apex between them. As with the types of game apparatus which have been previously discussed, this particular game apparatus merely involves the movement of game pieces horizontally on a particular playing surface or vertically between vertically spaced game surfaces.

Also notable as being of general interest in the field of game board apparatus is Wszalek U.S. Pat. No. 3,674,272 which involves a two-dimensional tic-tac-toe game board utilizing magnetized playing pieces.

SUMMARY OF THE INVENTION

The present invention relates to a novel, three-dimensional game apparatus which can be used to play games of varying complexity and difficulty. The apparatus, in basic form, is composed of a first polyhedronal body in the form of a first pyramid which has each of its surfaces divided into a plurality of areas formed by lines intersecting the mid-points of adjacent edges on each of the surfaces of the body. The game apparatus includes a second polyhedronal body in the form of a second pyramid having a shape different than the first pyramid but having each of its surfaces also divided into a plurality of areas formed by lines intersecting the mid-points of adjacent edges on each surface of said second body. Joiner means in the form of an elongate member interconnects the first and second pyramids in spaced parallel relationship. The first and second pyramids are disposed so that their respective vertices are directed toward each other and so that their respective end or base surfaces are in spaced parallel relationship. This particular structure allows either pyramid to serve as a base for supporting the other pyramid in spaced alignment vertically above it.

Either pyramid can be used individually as a game apparatus or they can both be used together to vary the number of playing surfaces to correspond to the skill of the players. Furthermore, a third pyramid can be placed on top of the particular pyramid serving as the upper pyramid to further increase the number of playing surfaces available.

A plurality of magnetic or like markers are provided which are selectively positionable within the areas of the first and second pyramids. The areas of the first and second pyramids are preferably constructed of magnetically permeable material to insure that the markers are held stationary when placed in a particular area. Moreover, the markers are divided into at least two visually distinct sets so that the players are able to determine which markers are being used by each player.

It is a principal object of the present invention to provide a three-dimensional game apparatus having playing surfaces on the faces of a polyhedronal body, which surfaces are simultaneously used in tic-tac-toe or Chinese checkers types of games.

Another object of the present invention is to provide a three-dimensional game apparatus adaptable to different levels of difficulty and skill by enabling not only the number of winning combinations and number of playing pieces to be varied, but also permitting the number of playing surfaces to be varied. A further object of the present invention is to provide a game apparatus in which playing surfaces are composed of the faces of at least two differently shaped polyhedronal bodies.

An additional object of the present invention is to provide a three-dimensional game apparatus which can be used to illustrate the geometric relationships between the surfaces of variously shaped polyhedronal bodies.

Still another object of the present invention is to provide a three-dimensional game apparatus in which the difficulty and the level of skill required to play the games can be varied by altering or restricting the maneuverability of the game pieces.

One more object of the present invention is to provide a three-dimensional game apparatus which can be simply and easily converted to play either a tic-tac-toe or a Chinese checkers type of game.

Another object of the present invention is to provide a three-dimensional game apparatus utilizing several different playing surfaces disposed in oblique adjacent relationship with respect to each other.

Yet another object of the present invention is to provide a three-dimensional game apparatus utilizing playing surfaces which are positioned in respect to each other in such a manner that it is not possible to view all such playing surfaces from any given direction.

DESCRIPTION OF THE PREFERRED EMBODIMENT

Figure 1:
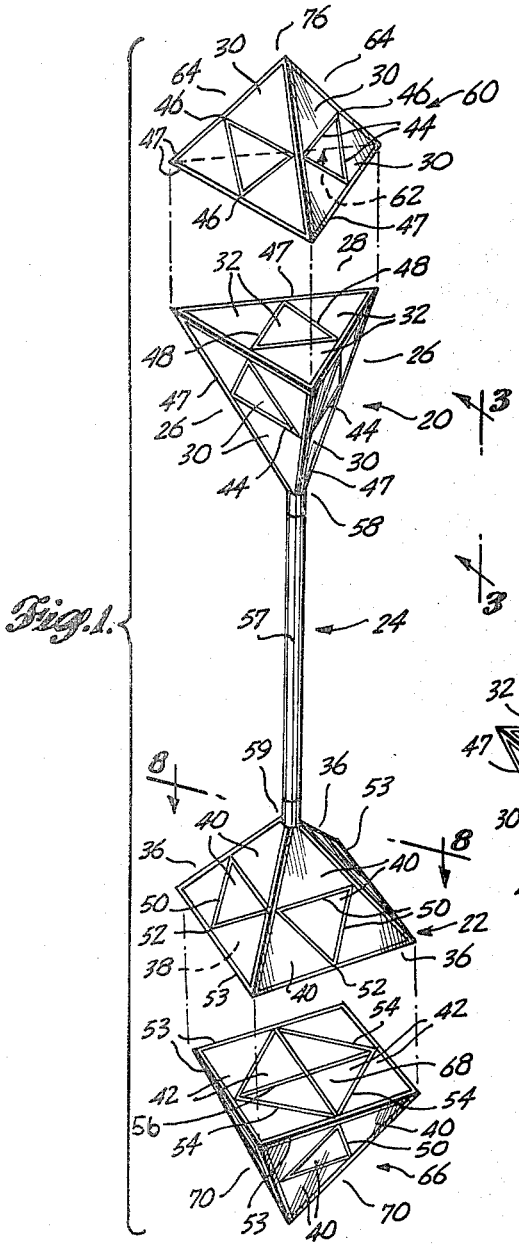
FIG. 1 is an exploded isometric view of an embodiment of the present invention, shown with a second tetrahedronal pyramid removed from the first tetrahedronal pyramid, and shown with a second pentahedronal pyramid removed from the first pentahedronal pyramid.

Referring initially to FIG. 1, there shown in isometric view is a typical three-dimensional game apparatus constructed according to the present invention. In preferred form, such comprises a first or upper polyhedronal body, shown in the shape of a first or upper pyramid 20, and a second or lower polyhedronal body, shown in the shape of a second or lower pyramid 22, which two pyramids are fixedly connected in spaced relationship by joiner means 24. Side surfaces 26 and base surface 28 of first pyramid 20 are each divided into a plurality of distinct areas or spaces 30 and 32, respectively, for receiving therein visually distinct markers 34 or 35. Likewise, side surfaces 36 and base surface 38 of second pyramid 22 are each divided into several distinct areas or spaces 40 and 42, respectively, for also receiving markers 34 and 35.

Again referring specifically to FIG. 1, the first polyhedronal body is formed in the shape of a first tetrahedronal right pyramid 20 having three identical side surfaces 26, each in the shape of an equilateral triangle and a triangular base surface 28 which is identical to said triangular side surfaces 26. It is to be understood that polyhedronal bodies of other configurations, such as a regular octahedron or regular dodecahedron, can be substituted for first tetrahedronal pyramid 20. Furthermore, pyramids other than in the form of a tetrahedronal pyramid can be used.

Each side surface 26 of first pyramid 20 is divided into four identical, equilateral triangular areas 30 by lines 44, which lines intersect the mid-points 46 of the adjacent edges 47 of each of said side surfaces 26. Likewise, base surface 28 of first pyramid 20 is also divided into four identical, equilateral triangular areas 32 by lines 48 which connect mid-points 46 of the adjacent edges 47 of base area 32. It is to be understood that games, certain of which are described below, which are playable with the present three-dimensional game apparatus, can also utilize the apparatus if each of the side surfaces 26 and base surface 28 is divided into a different number of areas than described above or into areas having shapes different than areas 30 and 32.

Lines 44 of side surfaces 26 and lines 48 of base 28 are shown in FIG. 1 as being painted on their respective surfaces. However, such lines can also be formed by other means such as by anodizing or by the use of colored paint or tape. Furthermore, grooves cut into, or ridges extending above, side surfaces 26 and base surface 28 can be used in place of painted lines 44 and 48, respectively.

A second or lower polyhedronal body, which is formed in the shape of a pentahedronal right pyramid 22, is also shown in FIG. 1. Second pyramid 22 has four identical side surfaces 36 in the shape of equilateral triangles and a square base surface 38. Each of side surfaces 36 is divided into four identical triangular areas 40 by lines 50 which interconnect the mid-points 52 of the adjacent edges 53 of said side surfaces 36. Also, base surface 38 is divided into eight identical triangular areas 42 by diagonal lines 54 which interconnect mid-points 52 of the adjacent edges 53 of said base area 38 and by lines 56 which interconnect the mid-points 52 of the opposite edges 53 of said base surface 38.

As discussed in conjunction with first pyramid 20, second pyramid 22 can be of a shape other than a pentahedron and, in fact, of a shape other than a pyramid and still incorporate the basic objectives of providing game surfaces, all of which simultaneously cannot be seen from a particular direction and which are disposed in oblique relationship to each other. Also, as with first pyramid 20, lines 50, 54 and 56 can be replaced by other dividing means such as grooves cut into or ridges rising above side surfaces 36 and base surface 38.

First pyramid 20 and second pyramid 22 are fixedly connected in spaced relationship by joiner means 24 which is shown in FIG. 1 as in the form of a straight, elongate circular rod 57. First pyramid 20 and second pyramid 22 are disposed by rod 57 such that their respective vertices 58 and 59 are pointed toward each other while their respective axes are aligned. This particular orientation between first and second pyramids 20 and 22, respectively, results in their corresponding base surfaces 28 and 38, being disposed in spaced parallel relationship such that either of said two base surfaces can serve as a base for supporting the opposite pyramid in spaced, vertically aligned relationship. Arranging first pyramid 20 and second pyramid 22 in this manner results in the three-dimensional game apparatus of the instant invention only occupying a minimum of surface or table area and permits it to be easily used in cramped quarters. Arranging the two pyramids 20 and 22 in spaced vertical relationship also enables the two pyramids to be used either individually or in combination to thus vary the number of game surfaces used. Furthermore, rod 57 can be held by one of the players when utilizing the apparatus, for instance, in moving vehicles such as automobiles or trains.

It is to be noted that joiner means other than rod 57 can be provided to interconnect first and second pyramids 20 and 22, respectively. Also rod 57, rather than being permanently attached, can instead be detachably connected to vertexes 58 and 59 and first and second pyramids 20 and 22, respectively, so that pyramids of different shapes or polyhedronal bodies other than pyramids can be substituted for each other. Furthermore, this construction enables the pyramids 20 and 22 to be detached from each other and placed on their respective bases to be utilized either individually or together.

Referring to FIG. 1, a third polyhedronal body 60, which is of a shape and size identical to first pyramid 20, is provided to be attached with said first pyramid when said first pyramid serves as the "upper" pyramid. first amd third pyramids 20 and 60, respectively, are suitably interengaged at their respective base surfaces 28 and 62 by conventional means such as magnets. The addition of third pyramid 60 provides additional side surfaces 64 on which a tic-tac-toe type of game, to be described below, can be played and also provides an apparatus for playing a Chinese checkers type of game, also to be described below. Side surfaces 64 and base surface 62 of third pyramid 60 are divided into marker receiving areas by lines 44 and 48 which areas are identical to areas 30 and 32, respectively.

Figure 13:
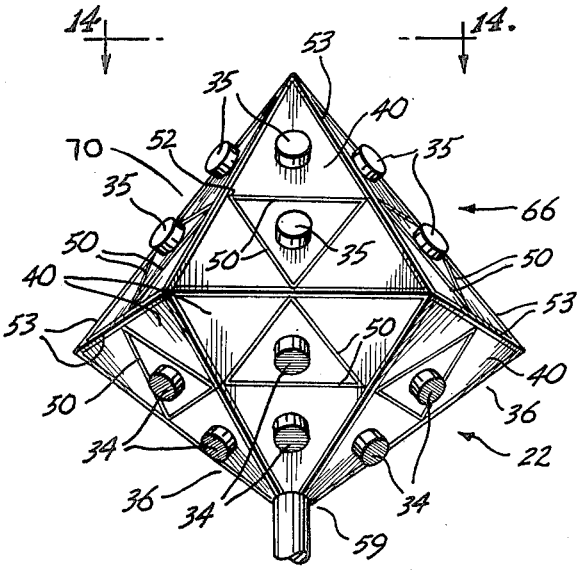
FIG. 13 is a fragmentary perspective view of the present invention illustrating the first and second pentahedrons joined together at their bases to form an octahedronal body and with the markers arranged in a winning configuration for a Chinese checkers type of game.

When first pyramid 20 serves as a base for second pyramid 22, a fourth pyramid 66, as shown in FIGS. 1 and 13, can be attached to said second pyramid 22 at their respective base surfaces 68 and 38. Fourth pyramid 66 is shown as being of a shape and size identical to second pyramid 22. Furthermore, side surfaces 70 and end surface 68 of fourth pyramid 66 is divided into triangular side surface areas identical to side surface areas 40 by lines 50 and into triangular base surface areas identical to base surface areas 42 by lines 54 and 56 as in second pyramid 22.

Fourth pyramid 66 can be attached to second pyramid 22 by conventional means such as by the use of magnets. These two pyramids can be joined together to either increase the number of playing surfaces for a tic-tac-toe type of game, to be described below, or to play a Chinese checkers type of game, also to be described below.

Both markers 34 and 35 are shown as being of the same cylindrical shape but of different colors to distinguish them from each other. In preferred form, markers 34 and 35 are of magnetic material and the outer surfaces of first pyramid 20, second pyramid 22, third pyramid 60 and fourth pyramid 66 are all constructed of magnetically permeable material to enable said markers 34 and 35 to be securely retained when placed on the surfaces of these pyramids.

Rather than being of cylindrical shape, markers 34 and 35 can be of any other desired shape and can be designed to resenble various objects, such as horses or race cars. Furthermore, markers 34 and 35 do not even have to be of identical or similar shape, as long as they are visually distinguishable.

Figure 15:
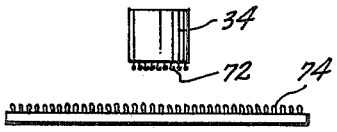
FIG. 15 is an enlarged, fragmentary, elevational view typically illustrating an alternative means for retaining markers 34, 35.

As an alternative means for retaining markers 34, 35 of the various pyramids, one or more surfaces of said two markers, as shown in FIG. 15, can be of finely woven nylon monofilaments formed into permanent hooks 72. Correspondingly, the outer surfaces of first pyramid 20, second pyramid 22, third pyramid 60, and fourth pyramid 66 can be covered with woven napped pile 74 forming a uniform disoriented surface of uncut loops. Thus, when markers 34 and 35 are pushed against the outer surfaces of any of the said four pyramids, said markers are tightly and securely attached thereto.

Furthermore, it is to be understood that any other suitable method for retaining markers 34 and 35 onto the outer surfaces of pyramids 20, 22, 60 and 66, such as by the use of clips or suction cups, or of pegs snuggly fitting within holes in the playing surfaces (much like cribbage board pegs), can be substituted for the magnets or hook and pile elements described above.

The apparatus, as described below, is particularly suitable for playing the following tic-tac-toe and Chinese checkers types of games, although obviously many other types of games also can be played. Furthermore, it will become apparent that the level of skill required to play these games can be altered by increasing or decreasing the number of playing surfaces used. This is accomplished by using the first pyramid 20 and the second pyramid 22 either individually or in combination and by either adding third pyramid 60 to first pyramid 20 or by adding fourth pyramid 66 to second pyramid 22.

TIC-TAC-TOE TYPE OF GAME

Figure 2:
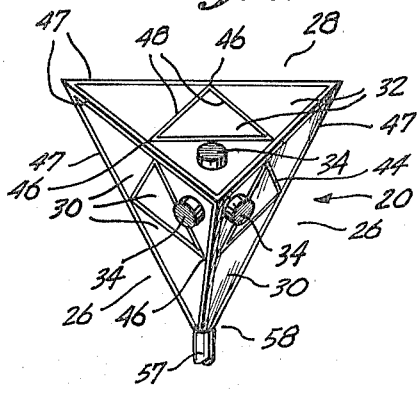
FIG. 2 is a fragmentary isometric view of an embodiment of the present invention taken along lines 3—3 and directed toward a vertex of the first tetrahedronal pyramid showing the markers arranged in a winning configuration for a tic-tac-type type of game.

Using the game apparatus of the present invention, a tic-tac-toe type of game is played by two individuals with the objective of the game being to position one's markers in a winning pattern before one's opponent does so. In one form of the game, which utilizes only tetrahedronal first pyramid 20, each of the two players begins with eight markers for a total of 16 markers between the two players, one for each of the triangular areas 30, 32 on the four surfaces 26, 28 of pyramid 20. As in tic-tac-toe, the players alternatively place one of their markers on an unoccupied triangular area of their choosing until a winning combination or a draw is reached. The winning combinations in this game include "three-on-a-point", which is shown in FIG. 2 as requiring an individual's markers 34 or 35 to occupy the three triangular areas 30, 32 adjacent to a particular apex. Since pyramid 20 has four apexes, four possible winning combinations of this type exist.

Figure 3:
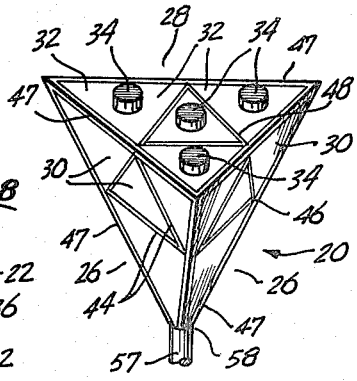
FIGS. 3, 4 and 5 are also fragmentary isometic views of the present invention directed toward a vertex of the first tetrahedronal pyramid markers arranged in a second, third and fourth winning configuration, respectively.

A second winning combination, as shown in FIG. 3, exists when the markers 34 or 35 of one player are arranged "four-on-a-face" or, in other words, the markers 34 or 35 of the player must occupy all four triangular areas 30 and 32 on one of the three side surfaces 26 or on base surface 28, respectively, of first pyramid 20. Four of these winning combinations are possible.

Figure 4:
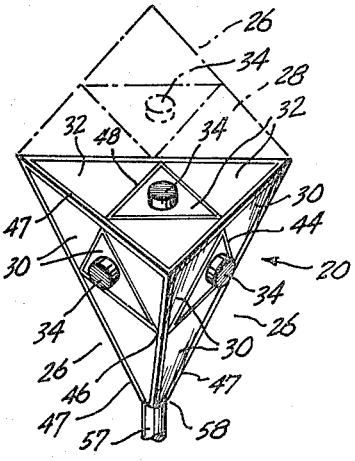

FIG. 4 illustrates a winning combination entitled "four-center-triangles" wherein the markers 34 or 35 of one player must occupy all four "center" triangles of side surfaces 26 and end surface 28 of first pyramid 20. As evident, there is only one such winning combination.

Figure 5:
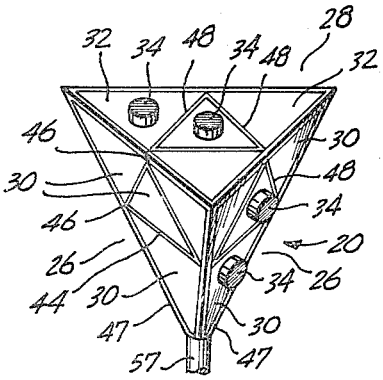

The last winning combination, shown in FIG. 5, is termed "four-in-a-row". This combination is achieved by arranging a player's markers 34, or 35, to interconnect two different apexes of first pyramid 20. The markers 34 or 35 must be placed in four adjoining triangular areas 30, 32 of two adjacent surfaces 26, 28 of pyramid 20 which two surfaces each only include one of the two apexes being interconnected. The other two surfaces 30 of first pyramid 20 each include both of the two apexes being joined. There are six possible winning combinations of this type making a total of 15 possible winning combinations in all.

It can be appreciated that the difficulty of this first type of tic-tac-toe game can be reduced by simply reducing the number of winning combinations by, for example, eliminating the six possible "four-in-a-row" combinations.

In a second type of tic-tac-toe game, using first pyramid 20, each player uses a limited number of markers 34 or 35, but at least four, which markers 34 or 35 are alternatively placed in a selective, unoccupied triangular area 30, 32 until all of the markers 34 or 35 being used have been placed on first pyramid 20. If none of the winning combinations, described above, have been achieved during the initial placement of markers 34 or 35 on first pyramid 20, the players then alternatively move their markers 34 and 35 between areas 30, 32 according to fixed rules, such as limiting movement between adjoining triangular areas 30, 32 which share a common side edge 47, or a common line 44, 48. Thus, it can be appreciated that this second form of tic-tac-toe also incorporates some of the concepts of checkers or chess.

Figure 8:
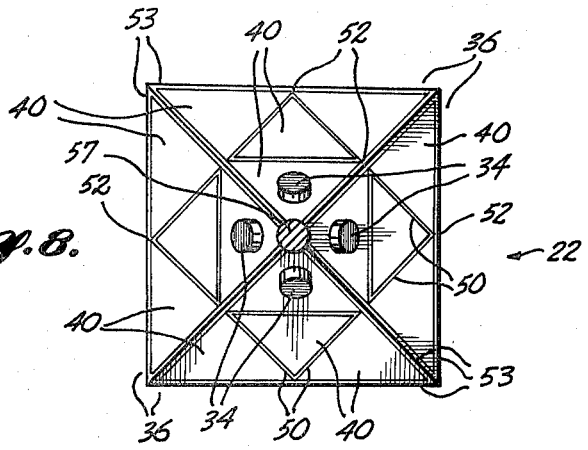
FIG. 8 is a cross-sectional view of FIG. 1 taken along lines 8—8 thereof and directed downwardly towards the vertex of the first pentahedronal pyramid illustrating the markers arranged in a first winning configuration for a tic-tac-toe type of game.

The two types of tic-tac-toe games, described above, can also be played with second pyramid 22. The possible winning combinations utilizing second pyramid 22 include "four-on-the-vertex". As suggested by its name, this combination requires, as shown in FIG. 8, the markers 34, or 35, of a player to occupy all four of the triangular areas 40 which adjoin the vertex 59 of second pyramid 22. There is but one such winning combination.

Figure 9:
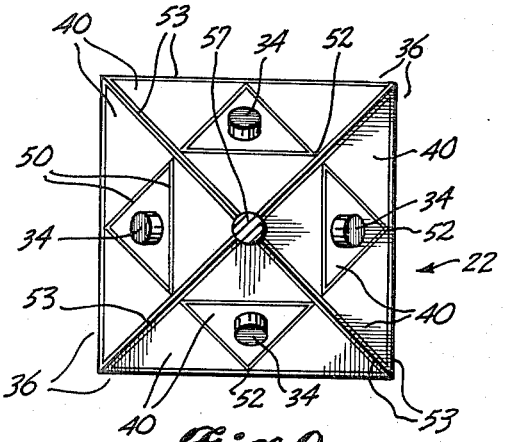
FIGS. 9 through 12 are views similar to FIG. 8; however, with the markers arranged in second, third, fourth, and fifth winning configurations, respectively.

A second winning combination is named "all four centers" and is achieved when the markers 34, or 35 of one player occupy all four of the "center" triangular areas 40 of the four side surfaces 36 of second pyramid 22. As illustrated by FIG. 9, there is only one such winning combination.

Figure 10:
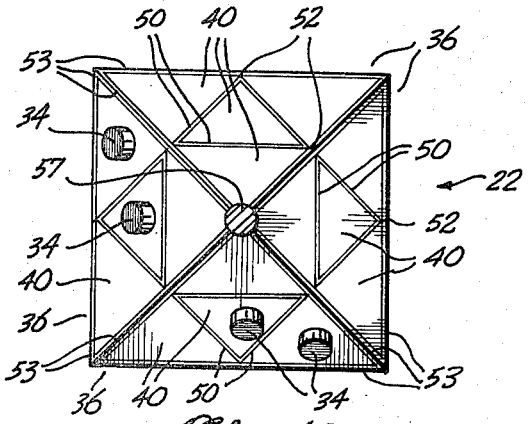

A third type of winning combination, "four-in-a-row apex-to-apex" is achieved by connecting diagonally opposed apexes by arranging markers 34 or 35, as shown in FIG. 10, so that they occupy the four adjoining triangular areas 40 on two adjacent side surfaces 36 of second pyramid 22. There are four possible winning combinations of this type.

Figure 11:
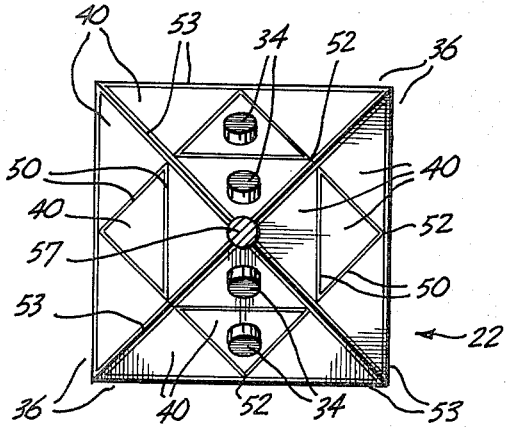

FIG. 11 illustrates a fourth possible winning combination utilizing second pyramid 22. This particular combination, which may be termed "four-in-a-row over the top", necessitates the markers 34 or 35 of one player to occupy the four aligned triangular areas 40 of two opposite side surfaces 36 such that vertex 59 is interposed between the second and third of such aligned triangular areas 40. There are two such possible winning combinations.

Figure 12:
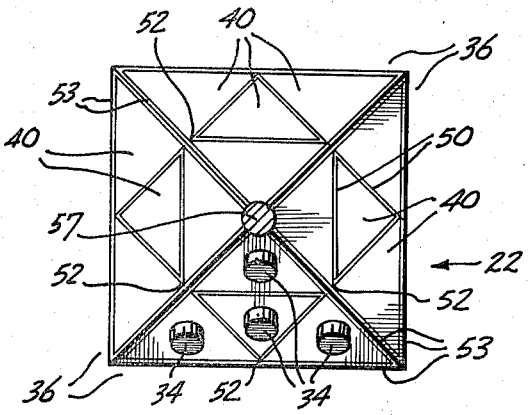

A fifth type of winning combination, as shown in FIG. 12, requires that the markers 34 or 35 of a particular player occupy all four triangular areas 40 of any one of the four side surfaces 36 of second pryamid 22. There are four such possible winning combinations to make a total of twelve winning combinations.

As with first pyramid 20, the second form of tic-tac-toe also can be played using second pyramid 22. Again each player is given a limited number of markers 34 or 35, preferably four each, which markers are initially placed in unoccupied side surface areas 40 by each player taking turns. If no winning combination is achieved during the initial placement of the markers 34 or 35, the two players then alternately maneuver their markers 34 or 35 between different triangular side surface areas 40 according to fixed rules, such as restricting such movement only between adjacent triangles 40 which share a common edge 53 or line 50.

Furthermore, to permit additional or other possible winning combinations, fourth pyramid 66 can be attached to second pyramid 22 in the manner previously described. It can be appreciated that even without employing fourth pyramid 66, tic-tac-toe games utilizing only second pyramid 22 are perhaps more difficult to play than if conventional three dimensional game apparatuses are used since all four playing surfaces 40 are not simultaneously visible from any one particular direction.

The first types of tic-tac-toe games, described above, can also be played while utilizing both first and second pyramids 20 and 22 simultaneously, rather than individually. This particular form of the first type of tic-tac-toe game includes all of the winning combinations described above which exist when first pyramid 20 alone is used plus all of the winning combinations described above which exist when second pyramid 22 alone is used. Thus, it can be appreciated that the level of skill required also has been correspondingly increased.

Furthermore, even another form of tic-tac-toe game can be played by adding, for instance, third pyramid 60 to first pyramid 20 and also simultaneously utilizing second pyramid 22. By using all three of these pyramids, enough playing surfaces exist to permit the players to incorporate many different winning combinations.

CHINESE CHECKERS TYPE OF GAME

Figure 6:
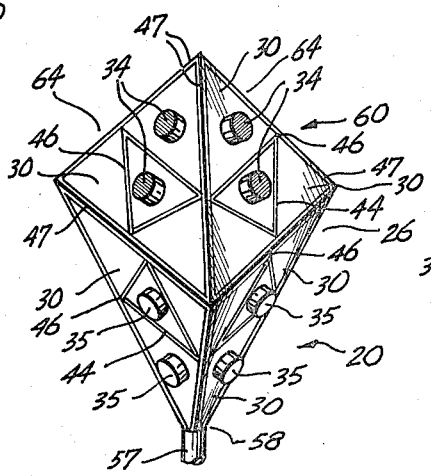
FIG. 6 is a fragmentary isometric view of the present invention showing the first and second tetrahedronal pyramids attached together to form a hexahedronal body as viewed along a vertex thereof and showing the markers arranged in a winning configuration for a Chinese checkers type of game.
Figure 7:
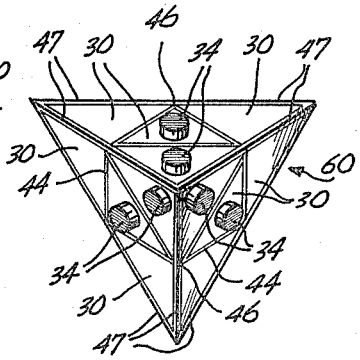
FIG. 7 is a plan view of the two tetrahedronal pyramids in FIG. 6 illustrating the markers arranged in the same winning configuration.

A game utilizing the basic principals of Chinese checkers can be played by engaging third pyramid 60 with second pyramid 22 at their respective base surfaces 62 and 28, as previously discussed and as illustrated in FIGS. 6 and 7. Six identical side surfaces 26 are thus available as playing surfaces. To play the game, each player uses six markers 34 or 35. The markers 35 of a first player are initially placed, for instance, on first pyramid 20 such that three of said markers occupy the triangular areas 30 which adjoin the vertex 58 of the said first pyramid 20 with the second set of three markers 35 of the first player occupying triangular areas 30 which share common lines 44 with the first set of said three triangular areas 30, in the manner shown in FIG. 6. The second player also has six markers 34 which are arranged about the opposite pyramid 60 in a fashion similar to the placement of the markers 35 of the first player.

The objective of this game is for each of the players to reposition his markers on the opposite pyramid and in the original pattern of his opponent. As in the conventional Chinese checkers game, the markers 34 or 35 are moved from one triangular area 30 to another unoccupied triangular area 30. Players move alternatively and are allowed to "jump" their own or their opponent's markers 34 or 35, but only if such movement occurs across lines 44 of edges 47 which separate adjacent triangular areas 30, but not across points or corners of adjacent triangles 30. Players may jump as many markers in one turn as possible. The first player to position all of his markers in the original pattern of his opponent is the winner.

Figure 14:
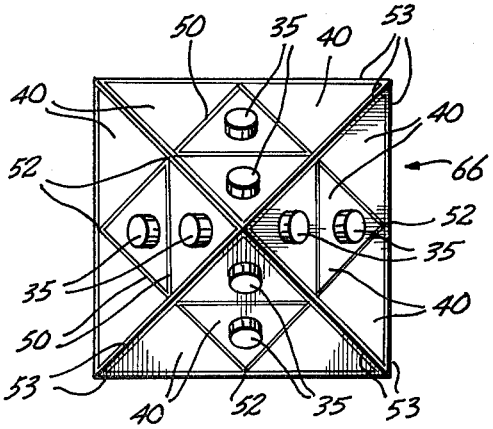
FIG. 14 is a view of the second pentahedron shown in FIG. 13 taken along lines 14—14 thereof and illustrating the markers arranged in the same winning configuration.

The above described Chinese checkers type of game can also be played with fourth pyramid 66 mounted on second pyramid 22 at their respective base surfaces 68 and 38, as previously discussed and as illustrated in FIGS. 13 and 14. Rather than playing with six markers each, as when tetrahedronal third pyramid 60 and first pyramid 20 are used, because second pyramid 22 and fourth pyramid 66 are both pentahedronal, eight markers are used by each player. In the initial positioning of the markers, markers 34, for instance, are arranged so that four of said markers 34 occupy triangular areas 40 which adjoin the vertex 59 of second pyramid 22. The four remaining markers 34 are placed in the triangular areas 40 which share common lines 50 with the triangular areas 40 in which the first four markers 34 were placed, as shown in FIGS. 13 and 14. The second player has eight markers 35 which are positioned about the opposite pyramid 66 in a manner similar to the placement of markers 34 of the first player.

As in the type of Chinese checkers game, which utilizes first pyramid 20 and third pyramid 60, the objective of the game here is to become the first player to reposition all of his markers 34 or 35 on the opposite pyramid and in the original pattern of his opponent. Also, the rules regarding the movement of the markers 34, 35 are the same.

Regardless of which two sets of pyramids are used, it can be appreciated that, by disposing the playing surfaces such that they cannot all be simultaneously viewed by the player, the present three-dimensional game apparatus increases the intrigue and difficulty of a conventional Chinese checkers game. Furthermore, the players are required to utilize geometric relationships of playing surfaces which are disposed in oblique relationship to each other as opposed to the single two-dimensional playing surface of a conventional Chinese checkers board.

It is to be understood that the above embodiment of this invention is shown and described for purposes of illustration only. Various changes may be made therein without departing from the spirit and scope of the invention. For example, the polyhedronal bodies do not even have to be connected to each other to enable them to be used either individually or together as a game apparatus.

What is claimed is:

1. A three-dimensional game apparatus comprising:

(a) a plurality of marker means;

(b) a first polyhedronal body having each of its surfaces divided into a plurality of marker means receiving areas for selectively receiving said marker means;

(c) a second polyhedronal body having each of its surfaces divided into a plurality of marker means receiving areas for selectively receiving said marker means; and (d) joiner means interconnecting said first and second polyhedronal bodies in spaced apart relationship, the said first and second polyhedronal bodies each including respectively oppositely facing flat surfaces, each alternately serving as a base surface for supporting the opposite polyhedronal body above the polyhedronal body corresponding to the base surface.

2. The game apparatus according to claim 1, wherein one of said two polyhedronal bodies is in the shape of a pyramid.

3. The game apparatus according to claim 2, wherein said pyramid is in the shape of a right pyramid such that the altitude of said pyramid coincides with the axis of said pyramid.

4. The game apparatus according to claim 1, wherein said first polyhedronal body is of a different shape than said second polyhedronal body.

5. The game apparatus according to claim 1, wherein said marker means are of at least two visually distinct sets, each of which is adapted to be receivable within said marker means receiving area of said first and second polyhedronal bodies.

6. The game apparatus according to claim 1, wherein the surfaces of each of said first and second polyhedronal bodies are arranged such that at least one of said surfaces is hidden from view when each said first and second polyhedronal bodies are observed from a selected direction.

7. The game apparatus according to claim 1, wherein first and second polyhedronal bodies are arranged so that adjacent surfaces of each of said first and second polyhedronal bodies are disposed in oblique orientation to each other.

8. A three-dimensional game apparatus comprising:

(a) a plurality of marker means;

(b) a first polyhedronal body having each of its surfaces divided into a plurality of marker means receiving areas for selectively receiving said marker means;

(c) a second polyhedronal body having each of its surfaces divided into a plurality of marker means receiving areas for selectively receiving said marker means;

(d) joiner means interconnecting said first and second polyhedronal bodies such that said two polyhedronal bodies are adapted to alternatively serve as a base polyhedronal body and as an upper polyhedronal body, said joiner means supporting said upper polyhedronal body in spaced vertical relationship above said base polyhedronal body; and (e) wherein said first polyhedronal body is in the shape of a first pyramid; said second polyhedronal body is in the shape of a second pyramid, the said first and second pyramids being disposed in spaced apart relationship by said joiner means with vertices of said first and second pyramids directed inwardly toward each other and with the base surfaces of said first and second pyramids in spaced parallel relationship.

9. The game apparatus according to claim 8, wherein said joiner means comprises an elongate member intersecting said first and second pyramids at respective vertices.

10. The game apparatus according to claim 8, wherein said first pyramid comprises a different number of surfaces than does said second pyramid.

11. The game apparatus according to claim 8, wherein:

(a) the outer surface of each side wall of said first and second pyramids is divided into four triangular areas so that the corners of said triangular areas of a first side wall coincide with the corresponding corners of said triangular areas of the adjacent side walls; and (b) the outer surface of the base of each of said first and second pyramids is divided into triangular areas such that the corners of said triangular areas of the base coincide with the corresponding corners of said triangular areas of the adjacent side walls.

12. The game apparatus according to claim 11, wherein one of said two pyramids is in the shape of a tetrahedron, and the second of said two pyramids is in the shape of a pentahedron.

13. The game apparatus according to claim 12, wherein:

(a) each of the triangular areas of each side wall and of the base of said tetrahedronal pyramid is in the shape of an equilateral triangle formed by lines interconnecting the mid-points of the adjacent edges of each side wall and the mid-points of the adjacent edges of the base of said tetrahedronal pyramid; and (b) each of said triangular areas of the side walls of said pentahedronal pyramid is in the shape of an equilateral triangle formed by lines interconnecting the mid-points of the adjacent edges of each side surface of said pentahedronal pyramid, and each of the triangular areas of the base of said pentahedronal pyramid is in the form of an equilateral triangle formed by lines interconnecting the mid-points of both the adjacent edges and the opposite edges of said base of said pentahedronal pyramid.

14. A three-dimensional game apparatus comprising:

(a) a plurality of marker means;

(b) a first polyhedronal body having each of its surfaces divided into a plurality of marker means receiving areas for selectively said marker means;

(c) a second polyhedronal body having each of its surfaces divided into a plurality of marker means receiving areas for selectively receiving said marker means;

(d) joiner means interconnecting said first and second polyhedronal bodies such that said two polyhedronal bodies are adapted to alternatively serve as a base polyhedronal body and as an upper polyhedronal body, said joiner means supporting said upper polyhedronal body in spaced vertical relationship above said base polyhedronal body; and (e) a third polyhedronal body adapted to be connected to said upper polyhedronal body to increase the number of playing surfaces and marker means receiving areas in which said marker means can be positioned.

15. The game apparatus according to claim 14, wherein said third polyhedronal body is of a shape and size identical to said upper polyhedronal body.

16. The game apparatus according to claim 15, wherein said third polyhedronal body and said upper polyhedronal body are each in the shape of a pyramid and are arranged together at their bases.

17. The game apparatus according to claim 16, wherein each surface of each of said two pyramids is divided into four triangular shaped marker means receiving areas established by lines interconnecting the mid-points of the adjacent edges of each said side surface of each of said two pyramids.

18. A game apparatus comprising:

(a) a first polyhedronal body having each of its surfaces divided into a plurality of areas;

(b) a second polyhedronal body having each of its surfaces divided into a plurality of areas;

(c) joiner means interconnecting said two polyhedronal bodies in spaced apart relationship to alternatively serve as a base surface for supporting said two polyhedronal bodies in spaced vertical relationships;

(d) a first flat end surface formed in the distal side of said first polyhedronal body opposite said second polyhedronal body;

(e) a second flat end surface formed in the distal side of said second polyhedronal body opposite said first polyhedronal body, said first and second end surfaces being disposed in spaced parallel relationship to each other to alternatively serve as a base for supporting said two polyhedronal bodies in spaced apart vertical relationship; and (f) a plurality of marker means selectively positionable within said areas of each of said first and second polyhedronal bodies, said marker means being adapted to be held stationary within said selected area.

19. A game apparatus comprising:

(a) a first polyhedronal body having each of its surfaces divided into a plurality of areas, one surface of said first polyhedronal body being a first end surface;

(b) a second polyhedronal body having each of its surfaces divided into a plurality of areas, one surface of said second polyhedronal body being a second end surface;

(c) joiner means interconnecting said two polyhedronal bodies in a spaced relationship wherein said first end surface forms the distal surface of said first polyhedronal body and wherein said second end surface forms the distal surface of said second polyhedronal body, said second end surface being disposed in spaced parallel relationship to said first end surface, enabling said first and second end surfaces to alternatively serve as a base surface for supporting said two polyhedronal bodies in spaced vertical relationships;

(d) a plurality of marker means selectively positionable within said areas of each of said first and second polyhedronal bodies, said marker means being adapted to be held stationary within said selected area;

(e) said first polyhedronal body is in the form of a first pyramid, with the base of said first pyramid serving as said first end surface;

(f) said second polyhedronal body is in the form of a second pyramid, the base of said second pyramid serving as said second end surface; and (g) each of the side surfaces and said base surface of said first and second pyramids being divided into triangularly shaped areas by lines interconnecting the mid-points of adjacent edges of each of said side surfaces and said base surface of said first and second pyramids.

20. The game apparatus according to claim 19, wherein each of said side surfaces of said first and second pyramids is in the form of an equilateral triangle.

* * * * *